United States Patent [19]

Buchanan

[11] Patent Number: 4,514,601

[45] Date of Patent: Apr. 30, 1985

[54] MULTISPEED INTERLOCKED PUSH BUTTON SWITCH MECHANISM

[75] Inventor: James D. Buchanan, Canton, N.C.

[73] Assignee: Square D Company, Palatine, Ill.

[21] Appl. No.: 550,262

[22] Filed: Nov. 8, 1983

[51] Int. Cl.[3] ..... H01H 9/20

[52] U.S. Cl. ..... 200/5 E; 200/5 R; 200/50 C

[58] Field of Search ..... 200/5 R, 5 E, 5 EA, 200/5 EB, 50 C, 291, 314, 153 L, 153 LA, 159 A

[56] References Cited

U.S. PATENT DOCUMENTS

| | | | |
|---|---|---|---|
| 1,607,270 | 11/1926 | Smith | 200/50 C X |
| 1,682,211 | 8/1928 | Bishop | 200/50 C |
| 3,312,122 | 4/1967 | Conner et al. | 200/50 C X |
| 4,385,214 | 5/1983 | Sullivan | 200/5 E |
| 4,388,503 | 6/1983 | Penland et al. | 200/5 R |

*Primary Examiner*—J. R. Scott

*Attorney, Agent, or Firm*—William H. Schmeling; A. Sidney Johnston

[57] ABSTRACT

The invention relates to a push button switch mechanism that has a pair of spaced operating buttons and plurality of electrically and physically interconnected movable contacts. The switch includes a plurality of stationary contacts that are engaged by the movable contacts when one of the switch buttons is moved from an at-rest position and a mechanism that is positioned between the push buttons to prevent simultaneous actuation of the push buttons and provide a tactile indication of a plurality of operated positions when one of the push buttons is moved from the at-rest position.

19 Claims, 14 Drawing Figures

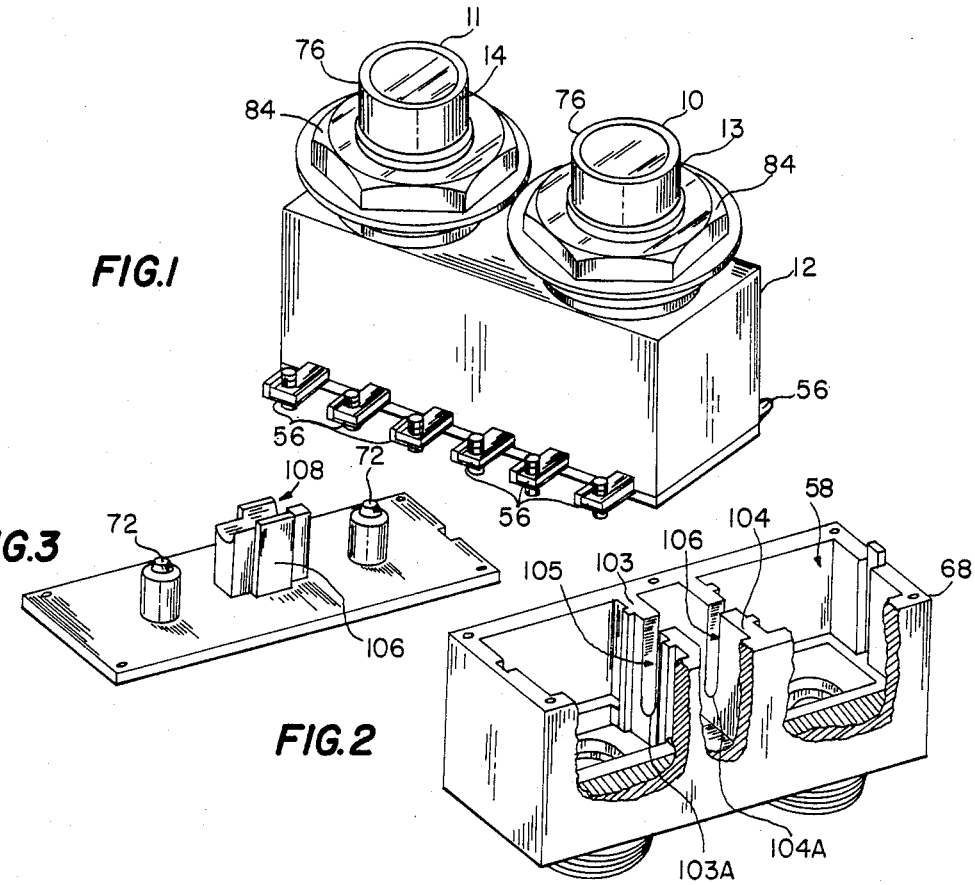
FIG.1
FIG.3
FIG.2
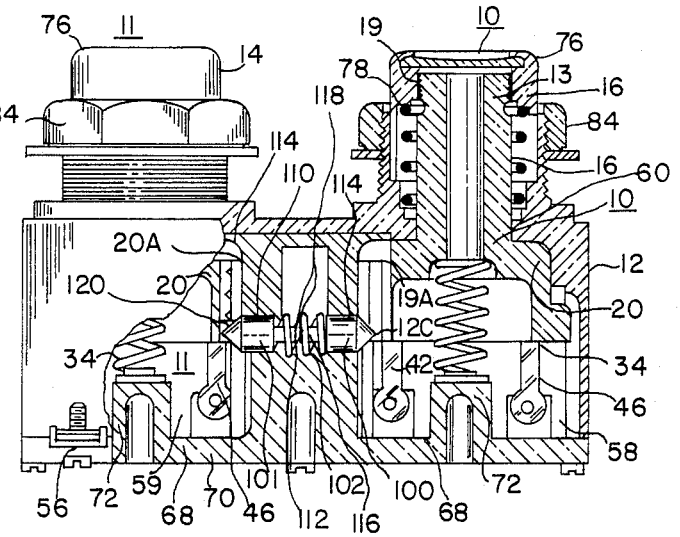
FIG. 4

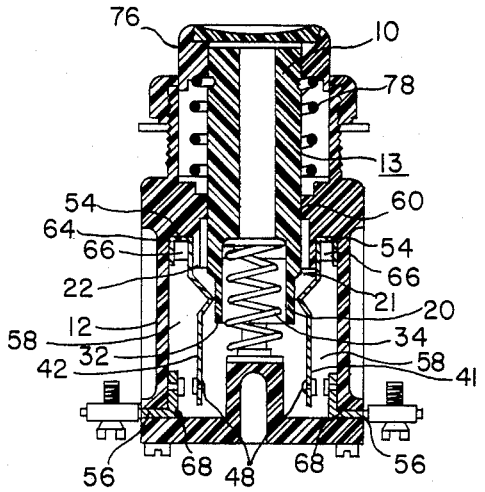
FIG.5
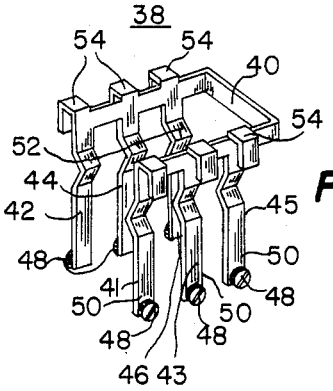
FIG.6
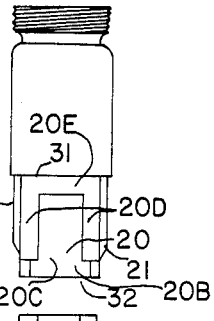
FIG.9
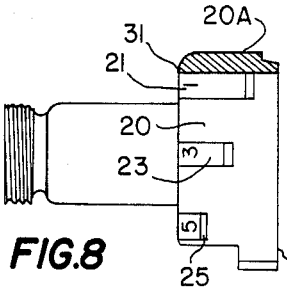
FIG.8
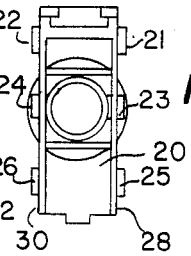
FIG.7
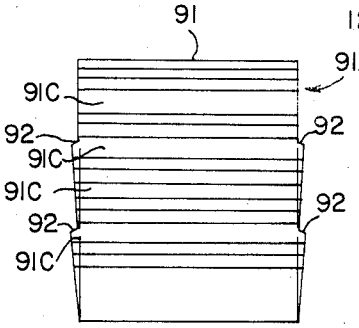
FIG.10
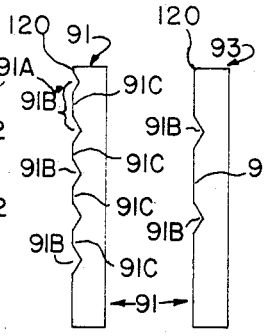
FIG.11
FIG.12
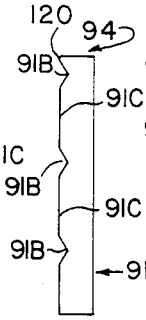
FIG.13
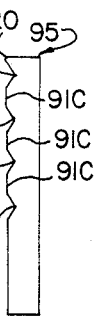
FIG.14

MULTISPEED INTERLOCKED PUSH BUTTON SWITCH MECHANISM

FIELD OF THE INVENTION

This invention relates to push button type switches and more particularly to an interlock and detent mechanism for push button switches.

BACKGROUND OF THE INVENTION

Push button type electric switches are well known as illustrated by U.S. Pat. No. 4,385,214 issued May 24, 1983, and assigned to the assignee of the present invention. While the push button structure disclosed in the '214 patent includes an interlock mechanism that provides a commercially acceptable operation, it is deficient in that it does not include a mechanism which will indicate the sequential operating steps as the switch plunger is depressed. Another switch that enjoys commercial acceptance is disclosed in a U.S. application for Pat. Ser. No. 292,776 filed August 14, 1981, now U.S. Pat. No. 4,388,503 and assigned to the assignee of the present invention. A deficiency in the switch when made according to the '776 patent application is that the switch does not include an interlock function to prevent simultaneous energization of electrical loads controlled by the switch.

The present invention has general applicability and is most advantageously applied to push button switches. One type of installation to which the present invention relates is an installation using a multiple speed reversible electric motor wherein it is required that the switch have a positive interlock to prevent simultaneous energization of the forward and reverse motor operation and positively and tactilely indicate the various discrete speed operating steps of the motor.

OBJECTS OF THE INVENTION

It is an object of the present invention to provide a two button push button switch with a novel interlock and detent mechanism.

Another object is to provide a push button switch with an inexpensive mechanism which will prevent simultaneous actuation of a pair of push buttons and tactilely indicate the operating state of the push buttons.

A further object is to provide an interlock and detent mechanism for a two button switch that uses a minimum number of parts and provides a readily discernible tactile sensation when the operating buttons of the switch are operated.

An additional object is to provide an interlock and detent mechanism for a two button switch with a structure that will accept a plurality of different inserts and thus determine the number of switching points of the switches and a stationary and movable contact structure that is changeable to vary the sequence and number of switching circuits controlled by the switches.

Another object is to provide a movable and stationary contact arrangement as well as an interlock and detent mechanism for a two button switch with a structure which will accept a plurality of different inserts and a variable number of operating cams and movable as well as stationary contacts which will permit the switching structure and the interlock and detent structure associated with each push button to be programmed to provide a tactile indication of the switching steps of each push button when the number of steps of the push buttons are different, provide an interlock structure which will prevent simultaneous actuation of both push buttons and provide different movable contact and stationary contact structures for the push buttons to vary the sequence and number of individual switching circuits controlled by the push buttons.

BRIEF DESCRIPTION OF THE DRAWINGS

The features of the present invention which are believed to be novel are set forth with particularity in the appended claims. The invention, together with further objects and advantages, may best be understood by reference to the following description taken in conjunction with the accompanying drawings, in the several figures of which like reference numerals identify like elements, and in which:

FIG. 1 is a perspective view of a push button switch embodying the present invention.

FIG. 2 is a perspective view having broken away portions of a housing part for the switch in FIG. 1.

FIG. 3 is a perspective view of a cover which is used with the housing part in FIG. 2.

FIG. 4 is a side elevation view with broken away portions to illustrate the invention embodied in the switch in FIG. 1.

FIG. 5 is a cross-sectional end view of the switch in FIG. 1.

FIG. 6 is a perspective view of a movable contact assembly utilized in the switch in FIG. 1.

FIGS. 7, 8 and 9 are top, side and end elevation views of a contact actuator as used in the switch shown in FIG. 4.

FIG. 10 is a face view of a member used in the switch to provide a preselected mode of operation of the switch and FIGS. 11–14 are side views of a member shown in FIG. 10 having varying preselected patterns to vary the operation of the switch in FIG. 1.

DETAILED DESCRIPTION

In the drawings FIG. 1 shows a pair of bush button switches 10 and 11 contained within a housing 12. As the switches 10 and 11 may be identical and mirror images of each other, only the switch 10 will be particularly described. The push button switch 10 includes an operating button 13 having a stem 16 that extends forwardly from a body portion 20 as shown in FIG. 4. The push button switches 10 and 11 and the housing 12 are more fully described in U.S. Pat. No. 4,388,503 which is assigned by the inventors Willian D. Penland and Harold F. Loew to the assignee of the present invention. As described in the application '776 the stem 16 is cylindrical in shape and extends from the body portion 20 to a front end 19 of the stem 16. The body portion 20 has a substantially rectangular shape.

As shown in FIGS. 7–9 the rectangular body portion 20 has three raised cam portions 21, 23 and 25 on a first side 28 and three raised cam portions 22, 24 and 26 on a second side 30 of the body 20. The body 20 has a predetermined length and the cam portion 21 extends substantially the entire length of the body 20. Each of the other raised portions 22, 23, 24, 25 and 26 extends from a first or front end 31 and terminates a predetermined staggered distance from a second or rear end 32 of the body 18.

The stem 16 is attached to the first end 31 and extends forwardly a predetermined distance from the end 31. As shown in FIG. 5 a return spring 34, positioned at the second end 32 of the body 20, constantly urges the button portion 10 forwardly in the housing 12.

As shown in FIG. 6, a movable contact assembly 38 has a substantially U-shaped support section 40. The section 40 surrounds the rectangular body portion 20. Three spring or movable contact elements 41, 43 and 45 extend from ond side of the support section 40 and three spring or movable contact elements 42, 44 and 46 extend from the other side of the support section 40. Each of the spring elements 41–46 has an electrical movable contact 48 on a first end 50 and a cam-engaging portion 52 adjacent a second end 54. The spring elements are connected to the support section 40 at the end 54 and are aligned to be engaged by the raised cam portions 21–26 on the body portion 20. FIG. 6 shows a perspective view of the movable contact assembly 38.

Six stationary contacts 56 that are engageable by the contacts 48 secured at the end of the spring element 41, 42, 43, 44, 45 and 46 of the movable contact assembly 38 are provided. Two of the contacts 56 are shown in FIG. 5.

The housing 12 has a rectangular chamber 58 in which the body portion 20 moves. A passage 60 for the stem 18 is provided in the housing 12. The housing 12 also has a socket 64, shown in FIG. 5, extending from the rectangular chamber 58 wherein the ends 54 of the movable contact assembly 38 are positioned. Blocks 66 secure the ends 54 in the pockets 64. The housing 12 also has an open rear end 68. A cover 70 is attached to close the open bottom 68 of the housing 12 helps support the six pairs of stationary electrical contacts 56 and provides abuttment posts 72 for the return springs 34. The six stationary contacts 56 are positioned by suitable recesses in the rear end 68.

A decorative cap 76 is threaded on the front end of the stem 18 in the assembled push button switch 10. The cap also provides a spring seat for one end of a return spring 78. The other end of the spring rests on a portion of the housing 12 as shown in FIG. 4.

Referring to FIGS. 7–9 in the preferred embodiment the second, third, fourth, fifth and sixth raised portions 22, 23, 24, 25 and 26 extend respectively approximately 1/6, 2/6, 3/6, 4/6 and 5/6 along the length of the body 20 from the first end 31. In operation, when the push button 13 is initially depressed, the first raised portion 21 almost immediately engages the first spring element 41 as it is moved to engage its corresponding stationary contact 56 referred to as a common terminal. As the push button is further depressed, the second raised portion 22 contacts and second spring element 42, and thereby establishes an electrical circuit between the common terminal C and the stationary contact 56 associated with the second spring element 42. As the cam 16 is further depressed, the remaining raised portions and spring elements will sequentially engage and thereby sequentially establish additional circuits between the contacts 48 and the stationary contacts 56.

FIG. 5 illustrates the operation of the push button switch 10. In this figure, the operating button 13 is partially depressed with the first cam portion 21 positioned to engage the spring element 41 and cause the electrical contact 48 on the spring element 41 to engage its associated stationary electrical contact 56. The second raised portion 22 has not engaged the second spring element 42 and therefore electrical connection between the electrical contact 48 on the second spring element 42 and the corresponding stationary electrical contact 56 has not been established. As the push button 10 is further depressed, the engagement is established and an electrical path between the two stationary electrical contacts 56 is completed.

FIG. 4 is a cross-sectional view of the push button switch 10 in an assembled form. A large nut 84 is provided to securing the push button switch 10 in suitable openings in a panel (not shown).

Various combinations of the raised portions on the body of the cam and the cam-engaging portions on the spring element are possible. In the preferred embodiment the raised portions are of such a length and orientation that the electrical contacts are engaged in a linear sequential fashion. By altering the lengths and number of the raised cam portions, the engagement of the movable and stationary contacts may be varied and switches may be furnished with different numbers of switching contacts and different intervals between switching steps. Further if desired the number of switching circuits controlled by the push button switches may be variable and different in number and made to occur in a linear or logarithmic or other sequence.

An interlock and detent mechanism operating between the switches 10 and 11 prevents the simultaneous operation of the switches 10 and 11. The mechanism also provides a tactile indication when the switch buttons 13 and 14 are depressed to indicate a plurality of stepped switching points of the switches 10 and 11. As shown in FIGS. 1–4 the push button switches 10 and 11 are enclosed within the housing 12 and include a pair of spaced linearly movable push buttons having body portions 20 as well as operating stem portions 16. The stem portions 16 extend externally of a front surface of the housing 12.

As previously described each of the switches 10 and 11 has a movable contact assembly 38 positioned in the housing 12. The movable contact assembly 38 as shown in FIG. 6 has a plurality of interconnected spring elements 41–46 with each element having a movable contact portion 48 and a portion 52 designated as a cam engaging portion. Each of the switches 10 and 11 also is provided with at least a pair of stationary contact assemblies 56 that are positioned between a rear end of the housing 12 and the cover 70. Each stationary contact assembly includes a wire connecting terminal portion that is located at the exterior of the housing 12 and a stationary contact that is positioned to be engaged by a movable contact 48 in response to a movement of one of the push buttons 13 or 14 from an at-rest position inwardly in the housing 12 to an operated position.

Positioned between the push button switches 10 and 11 is an interlock and detent mechanism 90. The mechanism 90 is provided to prevent the simultaneous actuation of the buttons 13 and 14 from the at-rest position to operated positions as well as provide a tactile indication or sensation when one of the buttons 13 or 14 is moved from the at-rest position to an operated position. The buttons 13 and 14 have corresponding body portions 20 and 19 movable in the chamber 58 and a chamber 59 respectively. The body portions 20 and 19 each have a surface confronting a similar surface that is spaced from a complementary surface on the other part. For descriptive purposes the confronting surface on the body portion 20 is designated as 20A and the confronting surface on the portion 19 is designated as 19A.

Each of the confronting surfaces 20A and 19A is provided with a socket designated as 20B and 19B respectively. As the sockets 20B and 19B are identical only socket 20B will be described. The socket 20B has a rear wall 20C and lips 20D spaced forwardly and overlying the wall 20C and extending from an open end to an end that is closed by an overlying lip 20E. Walls which form part of the lips 20D are spaced so an insert 91, shown on Drawings 10–14, may be inserted into the socket 20A and be maintained in its inserted position in the socket by barbs 92 that extend along the marginal edges of the insert 91 as shown in FIG. 10. The barbs 92 bite into walls forming the lips 20D. The inserts 91 have a face 91A that is exposed when the inserts 91 are positioned in their associated sockets 19A and B. The face 19A, as in FIGS. 10 and 11 is provided with five notches 91B that are spaced and separated by four dwell surfaces 91C. When an insert 91 that has five notches 91C is present in the sockets 19A and 19B, the switch mechanism 10 is programmed to provide five spaced positions which are tactilely discernible when the push buttons 13 and 14 are manually moved into the housing 12. If desired inserts 93, 94 or 95 having two, three or four notches as shown in FIGS. 12, 13 and 14 respectively may be used instead of the insert 91 in FIG. 11. When the inserts as shown in FIGS. 12, 13 and 14 are used the resulting push button switches will have two, three or four tactilely distinct operating positions when the push buttons 13 and/or 14 are operated.

As shown in FIGS. 2–4 the tactilely distinct indexed steps or positions of the push buttons 13 and 14 and the interlocking of the push buttons 13 and 14 is provided by a pair of movable plungers or pawls 100 and 101 and a compression spring 102.

Referring to FIG. 2, a plunger support section of the housing 12 includes a pair of walls 103 and 104 with grooves 105 and 106 respectively located substantially in the center of the walls 103 and 104. The bottom 105A and 106A of the grooves 105 and 106 is rounded to fit the configuration of the interlock pawls 100 and 101. Referring to FIG. 3 a plunger guide 106 comprises a block 108 having a predetermined length the ends of which fit between the walls 103 and 104 extends from a front surface of the cover 70. A top of the plunger guide 106 is rounded to fit the outer cylindric surface configuration of the pawls 100 and 101 and form a continuation and extend between the bottom 103A and 104A of the grooves 103 and 104.

When the cover 70 is secured to the rear end 54 of the housing 12, the plunger support section including the grooves 105 and 106 and the plunger guide 106 define a cylindrical passage 112 in which the pair of pawls 100 and 101 and the spring 102 are positioned as shown in FIG. 4. The interlock pawls 100 and 101 are in their at-rest position when both buttons 13 and 14 are at their at-rest positions.

The pawls 100 and 101 are identical and the description of pawl 100 will aptly describe the pawl 101. The pawl 100 has a cylindrical body portion 110 guided for reciprocal movement in the passage 112 with a taper 114 on an end that is urged into engagement with the detent insert 91. Preferably the taper 114 is complementary to the notches 91B. Extending from the body portion 110 at an end remote from the taper 114 is a stem 116 that is preferably cylindrical and has a surface at its free end designated as an abutting surface 118. When the interlock and detent mechanism 90 is installed in the passage 112 the pawls 100 and 101 face in opposite directions with their respective tapered ends 114 engaging the detent surfaces of the inserts 91 and when both push buttons 13 and 14 are at their respective at-rest positions the abutting surfaces 118 on the pawls 100 and 101 will be separated at their maximum spacing. When the pawls are thus positioned the compression spring 102, positioned in the passage 112, will surround the stems 116 on the pawls 100 and 101 and have its opposite ends engaging the cylindrical body portions 110 of the pawls 100 and 101 and surround the stems 116 on the pawls 100 and 101.

When both push buttons 13 and 14 are at their respective at-rest position, the spring 102 will urge the pawls 100 and 101 to their furthest separated positions whereat the spacing between the abutting surfaces 118 is maximum and either button 13 or 14 is conditioned to be moved from its at-rest position. When either button 13 or 14, i.e., push button 13 is moved from its at-rest position, the tapered end 114 will engage the end 120 of its associated insert 91 as in FIGS. 11–14 and move the pawl 100 toward the pawl 101 against the force exerted by the spring 102 to a position whereat the abutting surface 118 is spaced from the surface 118 on the pawl 101 as the pawl 100 moves into the first notch 91B on its associated insert. The spacing between the abutting surfaces 118 on the pawls 100 and 101 and the thickness of the inserts 91 as well as the depth of the notches 91B are selected so that the abutting surfaces 118 on the pawls 100 and 101 are spaced to prevent the pawl 101 from moving to a position which will permit the push button 14 to be depressed from its at-rest position when a manual force on the push button 13 is maintained in a position whereat the pawl 100 is positioned in one of the notches 91B in the insert 91 associated with the button 13.

The invention is not limited to the particular details of the apparatus depicted and other modifications and applications are contemplated. Certain other changes may be made in the above-described apparatus without departing from the true spirit and scope of the invention herein involved. It is intended, therefore, that the subject matter in the above depiction shall be interpreted as illustrative and not in a limiting sense.

I claim

1. A push button switch mechanism including:

a pair of spaced linearly movable push buttons and an interlock and detent mechanism positioned between the push buttons to prevent simultaneous actuation of the push buttons and provide tactile indications of a plurality of operated positions when one of the push buttons is moved from an at-rest position to the plurality of operated positions, the interlock and detent mechanism comprising: a surface on each push button spaced from and confronting a similar confronting surface on the other push button, a detent surface including a plurality of notches spaced by dwell surfaces on each confronting surface, a pair of spaced movable pawls and a spring positioned in the space between the confronting surfaces with each pawl having a taper at an end that is biased by the spring into engagement with one of the detent surfaces and an abuttable surface on an end of each pawl that is remote from the tapered end, the abuttable surfaces on the pawls being spaced when at least one push button is at its at-rest position and engageable with each other to prevent simultaneous movement of both push buttons from the at-rest position.

2. A push button switch mechanism including:

a housing, a pair of spaced linearly movable push buttons positioned in the housing and an interlock and detent mechanism positioned in the housing between the push buttons to prevent simultaneous actuation of the push buttons and provide tactile indications of a plurality of operated positions when one of the push buttons is moved from an at-rest position to the plurality of operated positions, the interlock and detent mechanism comprising: a surface on each push button spaced from and confronting a similar confronting surface on the other push button, a detent surface including a plurality of notches spaced by dwell surfaces on each confronting surface, a pair of spaced movable pawls and a spring positioned in the space between the confronting surfaces with each pawl having a taper at an end that is biased by the spring into engagement with the detent surface and abuttable surfaces on an end of each pawl that is remote from the tapered end, the abuttable surfaces on the pawls being spaced when at least one push button is at its at-rest position and engageable with each other to prevent simultaneous movement of both push buttons from the at-rest position, a movable contact assembly positioned in the housing and having at least two electrically and physically interconnected spring elements with each element having an electric contact portion and a cam engaging portion and at least one cam surface on each push button engageable with one of the cam engaging portions when one of the push buttons is moved from the at-rest position.

3. A push button switch mechanism including:

a housing a pair of linearly movable push buttons in the housing, each of said push buttons having a switching portion movable in the housing and an operating stem portion extending externally of the housing, a movable contact assembly positioned in the housing and having at least two electrically and physically interconnected spring elements with each element having a movable contact portion and a cam engaging portion, at least two stationary contact assemblies with each stationary contact assembly positioned by the housing and having a stationary contact portion engageable with one of the movable contact portions in response a movement of one of the push buttons from an at-rest position to an operative position, an interlock and detent mechanism positioned between portions of the push buttons in the housing to prevent simultaneous actuation of the push buttons and provide a tactile indication when one of the push buttons is moved from the at-rest position to an operated position, said interlock and detent mechanism comprising: a confronting surface on the switching portion on each push button spaced from and confronting a similar confronting surface on the other push button, a detent surface including a plurality of notches spaced by raised dwell surfaces on each confronting surface, a pair of spaced movable pawls and a spring positioned in the space between the confronting surfaces with each pawl having a taper at an end that is biased by the spring into engagement with the detent surface and an abuttable surface on an end of each pawl that is remote from the tapered end, the abuttable surfaces on the pawls being spaced when at least one push button is at the at-rest position and engageable with each other to prevent simultaneous movement of both push buttons from the at-rest position.

4. The switch mechanism recited in claim 1 wherein each confronting surface is provided with a socket and the detent surface is provided by a member that is inserted into the socket, said member providing the notches and the dwell surfaces to program the operation of the switch mechanism.

5. The switch mechanism recited in claim 2 wherein each confronting surface is provided with a socket and the detent surface is provided by a member that is inserted into the socket, said member providing the notches and the dwell surfaces to program the operation of the switch mechanism.

6. The switch mechanism recited in claim 3 wherein each confronting surface is provided with a socket and the detent surface is provided by a member that is inserted into the socket, said member providing the notches and the dwell surfaces to program the operation of the switch mechanism.

7. The switch mechanism as recited in claim 1 wherein each pawl has a cylindrical body portion that provides a guide surface, the taper extends from one end of the cylindrical body portion and the abuttable surface is provided by an end of a stem that extends from the body portion.

8. The switch mechanism as recited in claim 2 wherein each pawl has a cylindrical body portion that provides a guide surface, the taper extends from one end of the cylindrical body portion and the abuttable surface is provided by an end of a stem that extends from the body portion.

9. The switch mechanism as recited in claim 3 wherein each pawl has a cylindrical body portion that provides a guide surface, the taper extends from one end of the cylindrical body portion and the abuttable surface is provided by an end of a stem that extends from the body portion.

10. The switch mechanism as recited in claim 1 wherein portions of the housing provide the guide surfaces for the cylindrical body portions, the housing has an end closed by a cover and the cover includes a member that provides a guide surface for the cylindrical body portion of the pawl.

11. The switch mechanism as recited in claim 2 wherein portions of the housing provide the guide surfaces for the cylindrical body portions, the housing has an end closed by a cover and the cover includes a member that provides a guide surface for the cylindrical body portion of the pawl.

12. The switch mechanism as recited in claim 3 wherein portions of the housing provide the guide surfaces for the cylindrical body portions, the housing has an end closed by a cover and the cover includes a member that provides a guide surface for the cylindrical body portion of the pawl.

13. The switch mechanism in claim 4 wherein the notches and dwell surfaces are arranged on the member according to a preselected pattern and the pattern is variable to vary the programmed operation of the switch mechanism.

14. The switch mechanism in claim 5 wherein the notches and dwell surfaces are arranged on the member according to a preselected pattern and the pattern is variable to vary the programmed operation of the switch mechanism.

15. The switch mechanism in claim 6 wherein the notches and dwell surfaces are arranged on the member according to a preselected pattern and the pattern is variable to vary the programmed operation of the switch mechanism.

16. The switch mechanism as recited in claim 13 wherein each pawl has a cylindrical body portion that provides a guide surface, the taper extends from one end of the cylindrical body portion and the abuttable surface is provided by an end of a stem that extends from the body portion.

17. The switch mechanism as recited in claim 14 wherein each pawl has a cylindrical body portion that provides a guide surface, the taper extends from one end of the cylindrical body portion and the abuttable surface is provided by an end of a stem that extends from the body portion.

18. The switch mechanism as recited in claim 15 wherein each pawl has a cylindrical body portion that provides a guide surface, the taper extends from one end of the cylindrical body portion and the abuttable surface is provided by an end of a stem that extends from the body portion.

19. The switch mechanism as recited in claim 5 wherein each cam engaging portion includes a selected number of cams and a selected number of spring elements whereby the switch mechanism has a selected variable number of switching contacts.

* * * * *